US007101317B2

(12) United States Patent
Kuo

(10) Patent No.: US 7,101,317 B2
(45) Date of Patent: Sep. 5, 2006

(54) EXERCISE DEVICE

(75) Inventor: Parkson Kuo, Taipei (TW)

(73) Assignee: Via Technologies, Inc., Taipei (TW)

( * ) Notice: Subject to any disclaimer, the term of this patent is extended or adjusted under 35 U.S.C. 154(b) by 476 days.

(21) Appl. No.: 10/644,877

(22) Filed: Aug. 21, 2003

(65) Prior Publication Data

US 2004/0038779 A1 Feb. 26, 2004

(30) Foreign Application Priority Data

Aug. 21, 2002 (TW) ..... 91213029 U

(51) Int. Cl.
*A63B 22/00* (2006.01)
*A63B 22/02* (2006.01)

(52) U.S. Cl. ..... 482/54; 482/51; 482/52; 482/35

(58) Field of Classification Search ..... 482/35–37, 482/51–54; 119/700
See application file for complete search history.

(56) References Cited

U.S. PATENT DOCUMENTS

| | | | | |
|---|---|---|---|---|
| 5,114,389 | A * | 5/1992 | Brentham, Jerry D. | 482/53 |
| 5,226,866 | A * | 7/1993 | Engel et al. | 482/70 |
| 5,328,420 | A * | 7/1994 | Allen | 482/52 |
| 5,336,146 | A * | 8/1994 | Piaget et al. | 482/54 |
| 5,669,856 | A * | 9/1997 | Liu | 482/51 |
| 6,348,024 | B1 * | 2/2002 | Hwang | 482/52 |
| 6,893,383 | B1 * | 5/2005 | Chang et al. | 482/54 |

* cited by examiner

*Primary Examiner*—Glenn E. Richman
(74) *Attorney, Agent, or Firm*—Rabin & Berdo P.C.

(57) ABSTRACT

An exercise device. A body, display, plurality of treads and risers, transmission device, elevating device, handrail, controller, panel, and display provide operation wherein the treads and risers pivot on the transmission device. In a stairclimber orientation, the risers bracket the treads on the transmission device, moving by means thereof. In a treadmill configuration, the treads and the risers rotate to lie on the transmission device, forming a consecutive surface thereon.

23 Claims, 13 Drawing Sheets

E1'

EXERCISE DEVICE

BACKGROUND OF THE INVENTION

1. Field of the Invention

The present invention relates to an exercise device, and in particular to a compound exercise device provided with treadmill and climbing actions to provide a wide variety of interactive exercise options.

2. Description of the Related Art

Exercise devices of various types are well known and popular. However, exercise is often repetitive and boring, especially when performed indoors. One widely used exercise device is a treadmill, comprising a belt 13 driven by roller shafts 15*a* and 15*b*, as shown in FIG. 1. Settings such as speed are input from a panel 100 and a handrail 11 is held while running on the belt 13. Front and back roller shafts 15*a*, 15*b* either actively drive the belt 13 as the user 10 runs or walks thereon, or, in passive mode, freely rotate, driven by user tread activity producing friction on belt 13.

In FIG. 2, a conventional stair climbing exerciser has a plurality of treads 20, a panel 22 and a body 24. The treads 20 move circularly within the body 24 and electrically connect to the panel 24, such that the speed of the treads 20 can be adjusted by the user through the panel 22.

Even so, these devices provide only a very limited range of exercise experience, and thus, little motivation or interest to the user.

SUMMARY OF THE INVENTION

Accordingly, an object of the invention is to provide an exercise device, providing both treadmill and stairclimber functions, providing walking, running, and climbing experiences to make exercise routines fresh and motivating.

Another object of the invention is to provide an exercise device, with a display or other simulation apparatus, offering the user a simulated environment for both mental and physical interactivity.

The invention has a body, a display, a plurality of treads and risers, a transmission device, an elevating device, a handrail, a controller, a panel and a display. The treads and risers are movable plates pivoting on the transmission device. In a stairclimber configuration, the treads are bracketed by the risers to form a series of steps moved by the transmission device. In treadmill configuration, the treads and the risers rotate to lie on the transmission device to form a consecutive surface thereon.

A detailed description is given in the following embodiments with reference to the accompanying drawings.

BRIEF DESCRIPTION OF THE DRAWINGS

The present invention can be more fully understood by reading the subsequent detailed description and examples with reference made to the accompanying drawings, wherein.

DETAILED DESCRIPTION OF THE INVENTION

Figure 1:
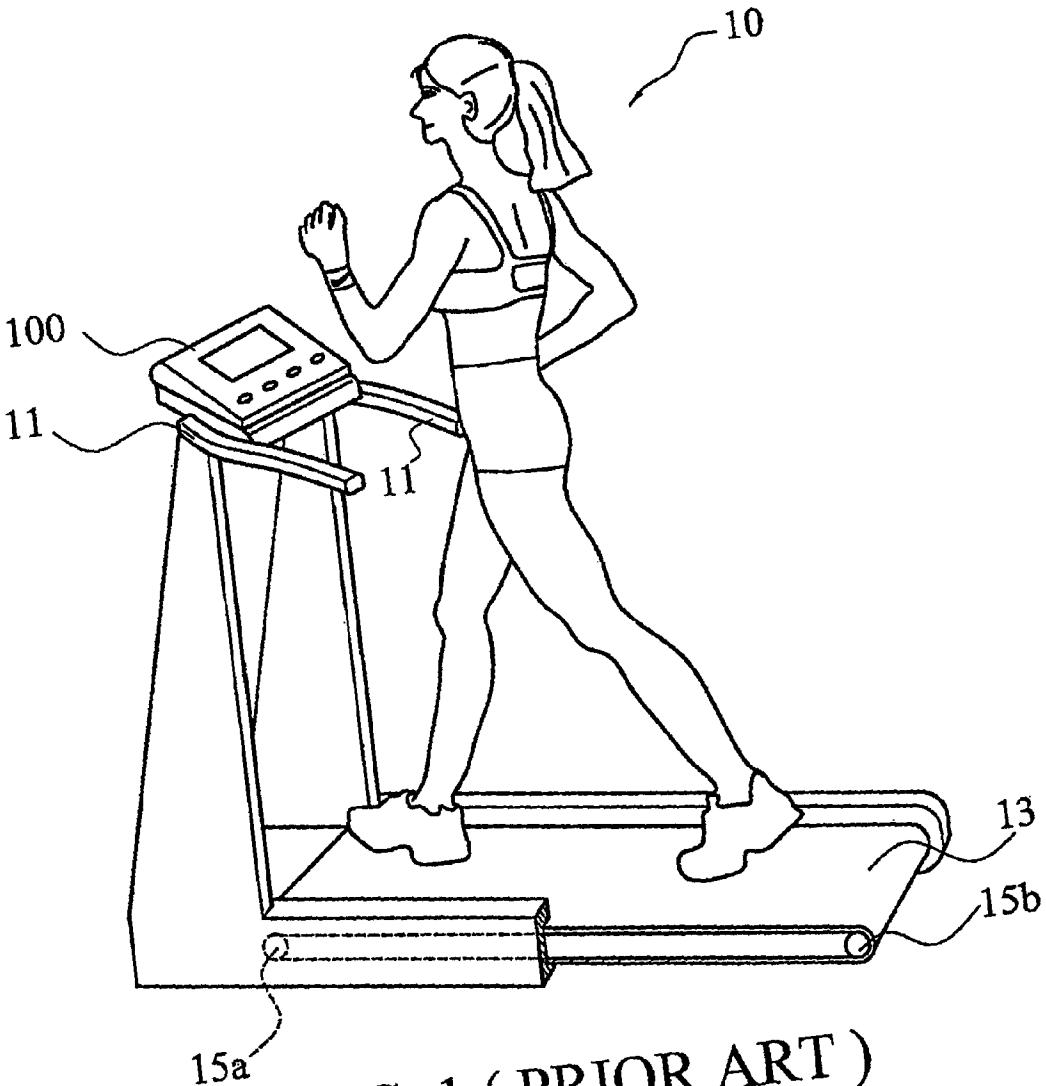
FIG. 1 ( PRIOR ART )
FIG. 1 is a schematic view of a conventional treadmill exerciser.
Figure 2:
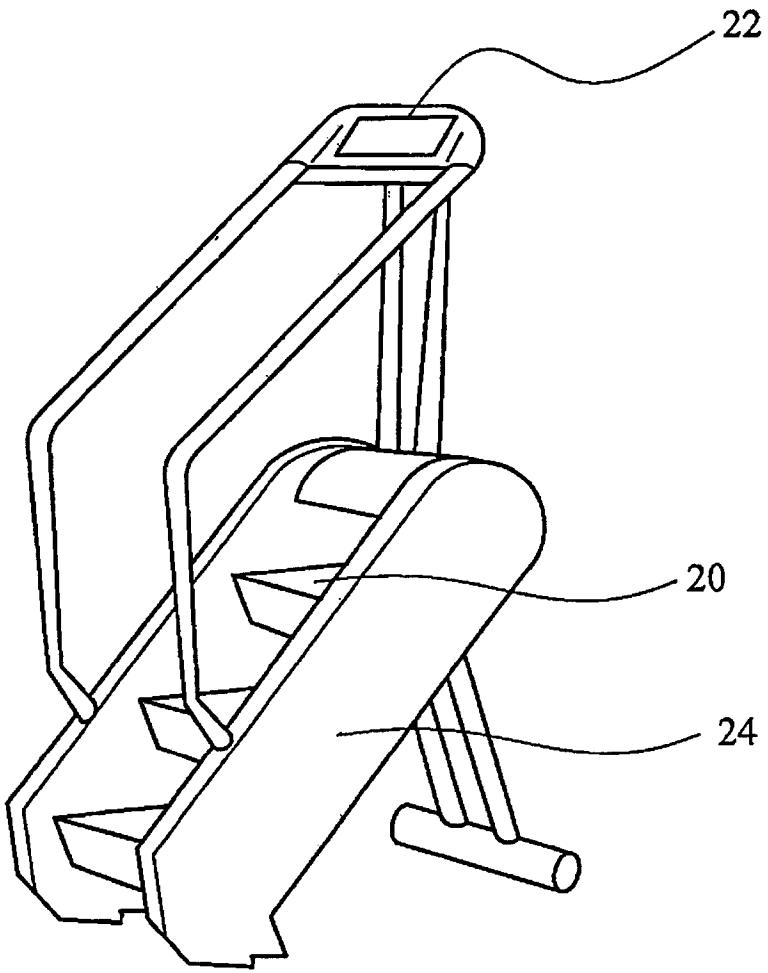
FIG. 2 ( PRIOR ART )
FIG. 2 is a schematic view of a conventional stairclimber exerciser.
Figure 3A:
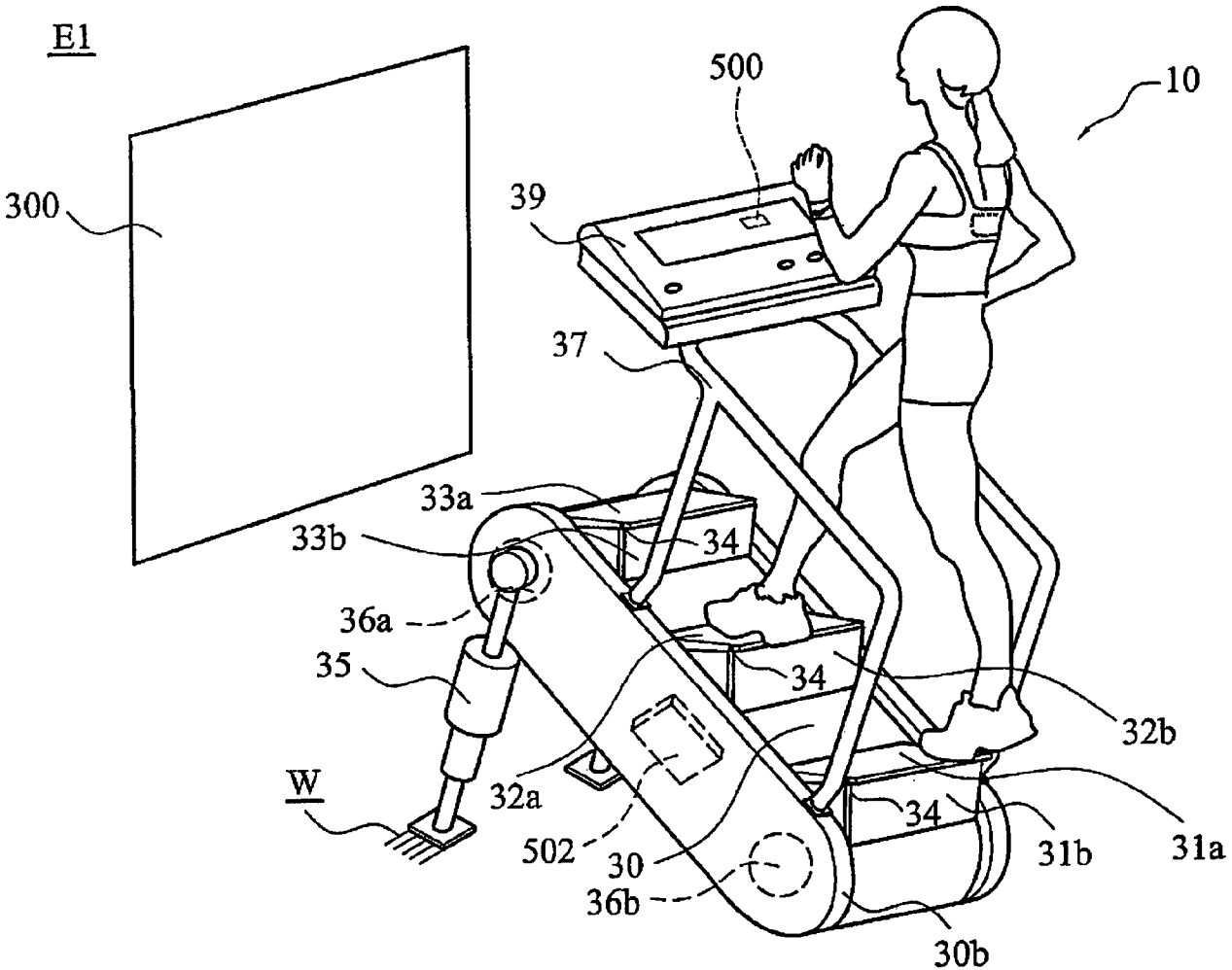
FIG. 3A is a schematic view of an exercise device (E1) of a first embodiment of the invention, with the exercise device deployed in a stairclimber configuration.

Referring to FIG. 3A, in a first embodiment of the invention, an exercise device E1 with treadmill and stairclimber functions is deployed in a stairclimber orientation.

The exercise device E1 has a body 30*b*, *a* display 300, a plurality of treads (31*a*, 32*a*, 33*a* . . . ), a plurality of risers (31*b*, 32*b*, 33*b* . . . ), a plurality of connectors 34, a transmission device 30, two transmission shafts 36*a* and 36*b*, an elevating device 35, a handrail 37, a controller 502 and a panel 39.

Figure 3B:
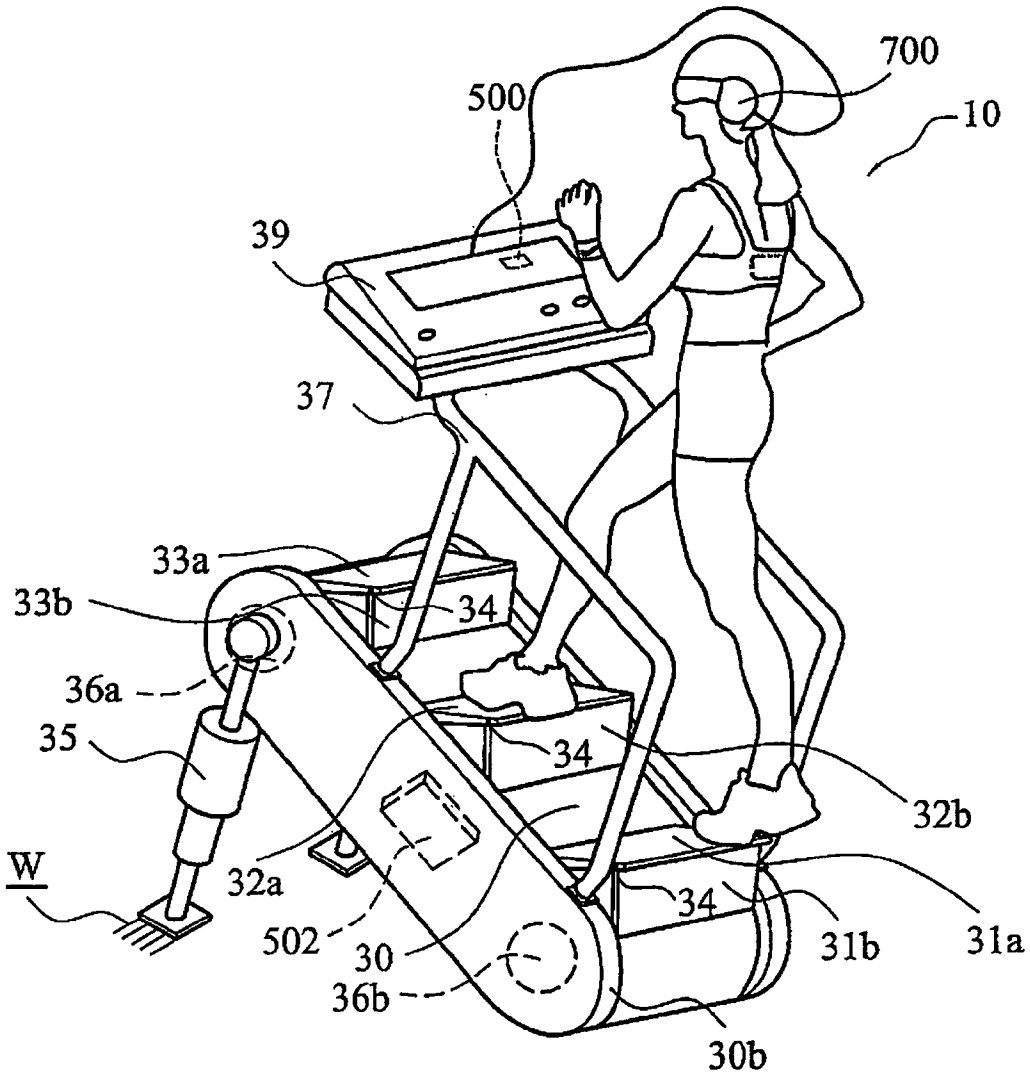
FIG. 3B is a schematic view of an exercise device (E1') of a second embodiment of the invention, with the exercise device deployed in a stairclimber configuration.
Figure 3C:
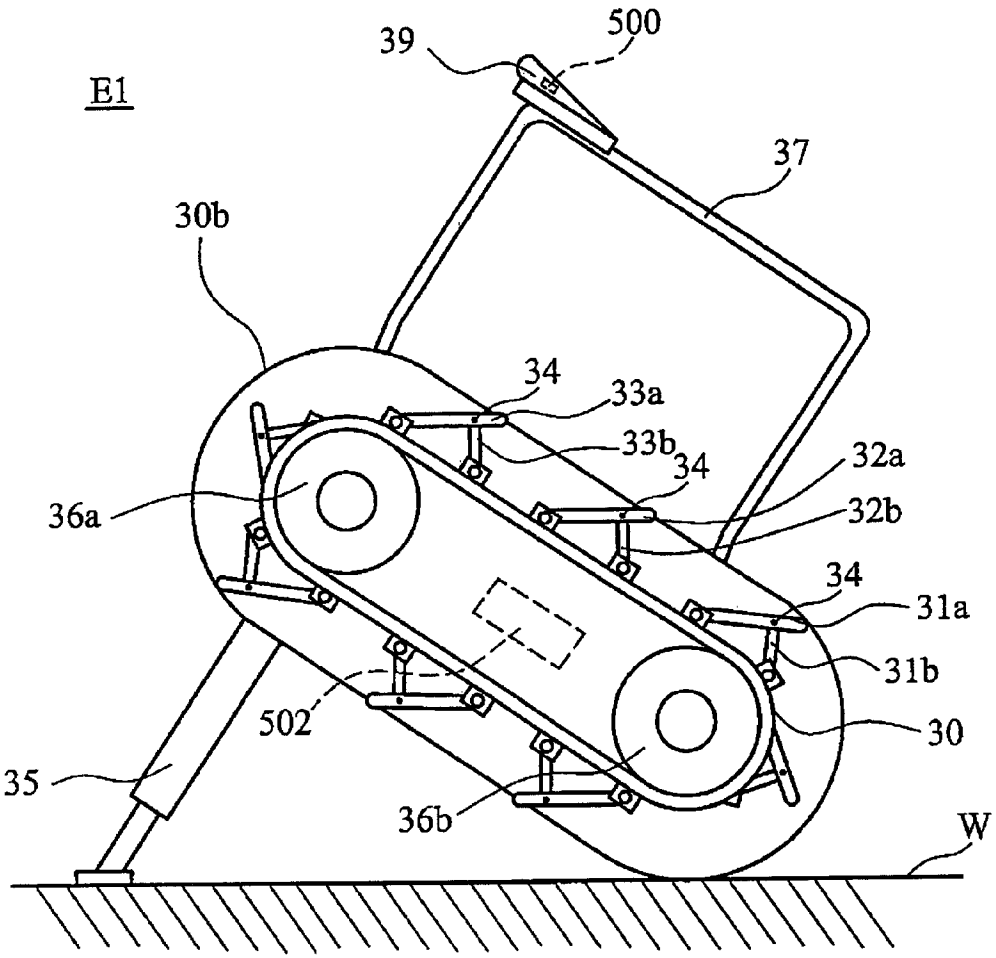
FIG. 3C is a side view of the exercise device (E1) of FIG. 3A.

In FIG. 3C, a side view shows the inner structure of the exercise device E1 in FIG. 3A. The display 300, handrail 37, transmission device 30, and transmission shafts 36*a*, 36*b* are disposed on the body 30*b*. The transmission device 30 is a belt disposed on the transmission shafts 36*a*, 36*b*, such that the transmission device 30 rotates thereby.

The treads (31*a*, 32*a*, 33*a* . . . ) and the risers (31*b*, 32*b*, 33*b* . . . ) individually pivot on the transmission device 30, and the connectors 34 in this embodiment of the invention are pins. Each tread (31*a*, 32*a*, 33*a* . . . ) and riser (31*b*, 32*b*, 33*b* . . . ) is symmetrically deployed in pairs on the transmission device 30. For example, a first tread 31*a* and a first riser 31*b* are paired and detachably coupled by the connector 34, a second tread 32*a* and riser 32*b* are paired and detachably coupled by the connector 34, and a third tread 33*a* and riser 33*b* are paired and detachably coupled by the connector 34. That is to say, in a stairclimber orientation in FIGS. 3A and 3B, the first riser 31*b* brackets the first tread 31*a*, the second riser 32*b* brackets the second tread 32*a*, and the third riser 33*b* brackets the third tread 33*a*.

The elevating device 35 is a hydraulic device coupled to the body 30*b*, such that the body 30*b* can be set at a predetermined position to keep the treads (31*a*, 32*a*, 33*a* . . . ) bracketed by the risers (31*b*, 32*b*, 33*b* . . . ) in a useable horizontal orientation.

The controller 502 disposed in the body 30*b* is coupled to the transmission device 30 and the elevating device 35, respectively. The panel 39, having a processing unit 500 therein and coupled to the controller 502, is disposed on the handrail 37 at the front of the exercise device E1, enabling input of operational settings such as speed and active or passive mode selection. In passive mode, the user 10 can run at any desired speed, controlling the speed of the transmission device 30 of the exercise device E1. In passive mode, a predetermined speed is set, and followed by the user 10.

When the transmission device 30 rotates around the transmission shafts 36*a*, 36*b*, coupled first riser 31*b* and first tread 31*a*, second riser 32*b* and second tread 32*a*, and third riser 33*b* and third tread 33*a* move together by means of the transmission device 30.

Figure 3D:
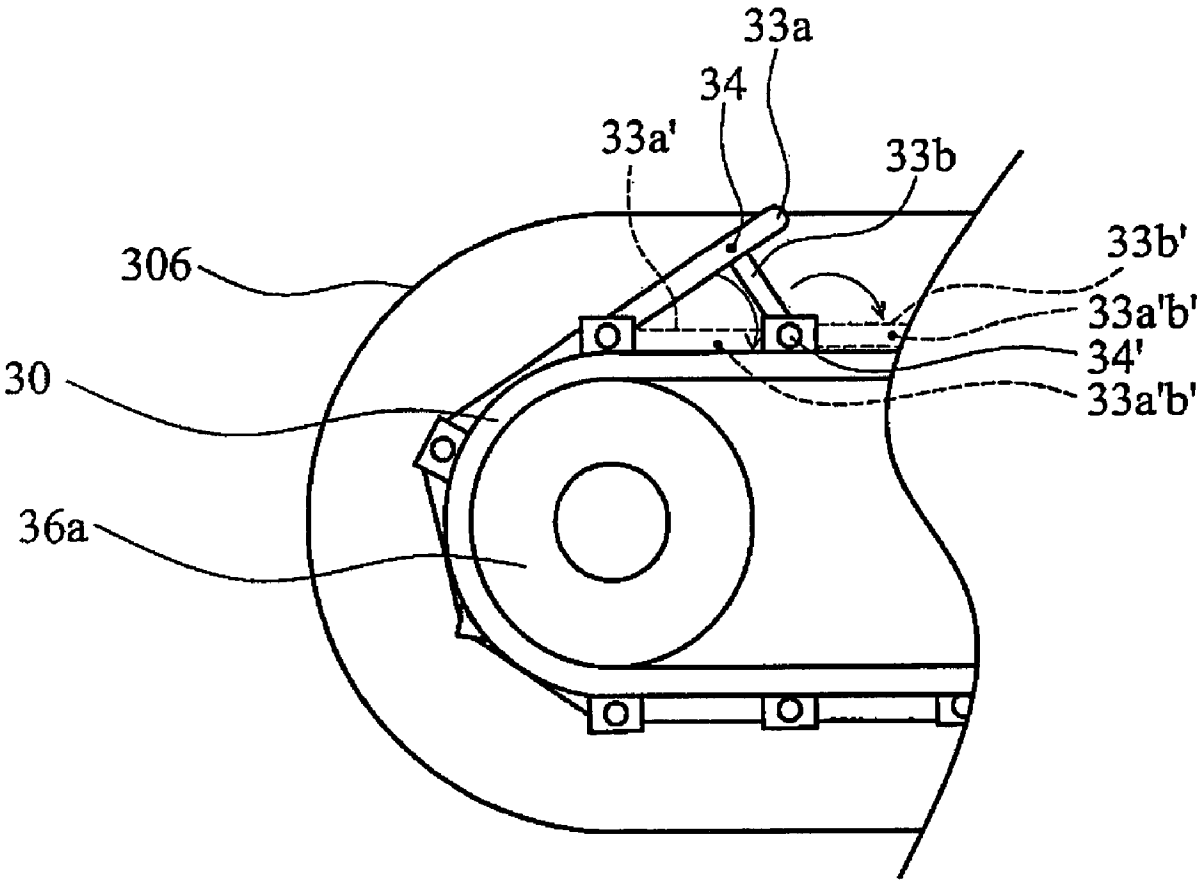
FIG. 3D is a partially enlarged view of the exercise device (E1) in FIG. 3C.

In FIGS. 3D, 33*a*' and 33*b*' indicate a position of a first deployment (dotted line) of the third tread 33*a* and the third riser 33*b* when the exercise device E1 is deployed to treadmill configuration from a stairclimber configuration, and symbol 33*a*'*b*' indicates a position of a second deployment (dotted line, the same position as 33*a*' and 33*b*') of the third tread 33*a* and the third riser 33*b* when the exercise device E1 is deployed to treadmill configuration from a stairclimber configuration.

When the connector 34 is removed, the third tread 33*a* and the third riser 33*b* respectively rotate in a clockwise direction and lie on the transmission device 30, i.e., shown by the third tread 33*a*' and the third riser 33*b*'.

When the connector 34 is not removed, remaining between the third tread 33*a* and the third riser 33*b* but removing a pivot 34' between the third riser 33*b* and the transmission device 30, the third riser 33*b* is coupled to the third tread 33*a* by the connector 34. The third tread 33*a* and third riser 33*b* rotate in a clockwise direction and lie on the transmission device 30, as shown by the third tread contacting the third riser 33*a*'*b*'.

Figure 4A:
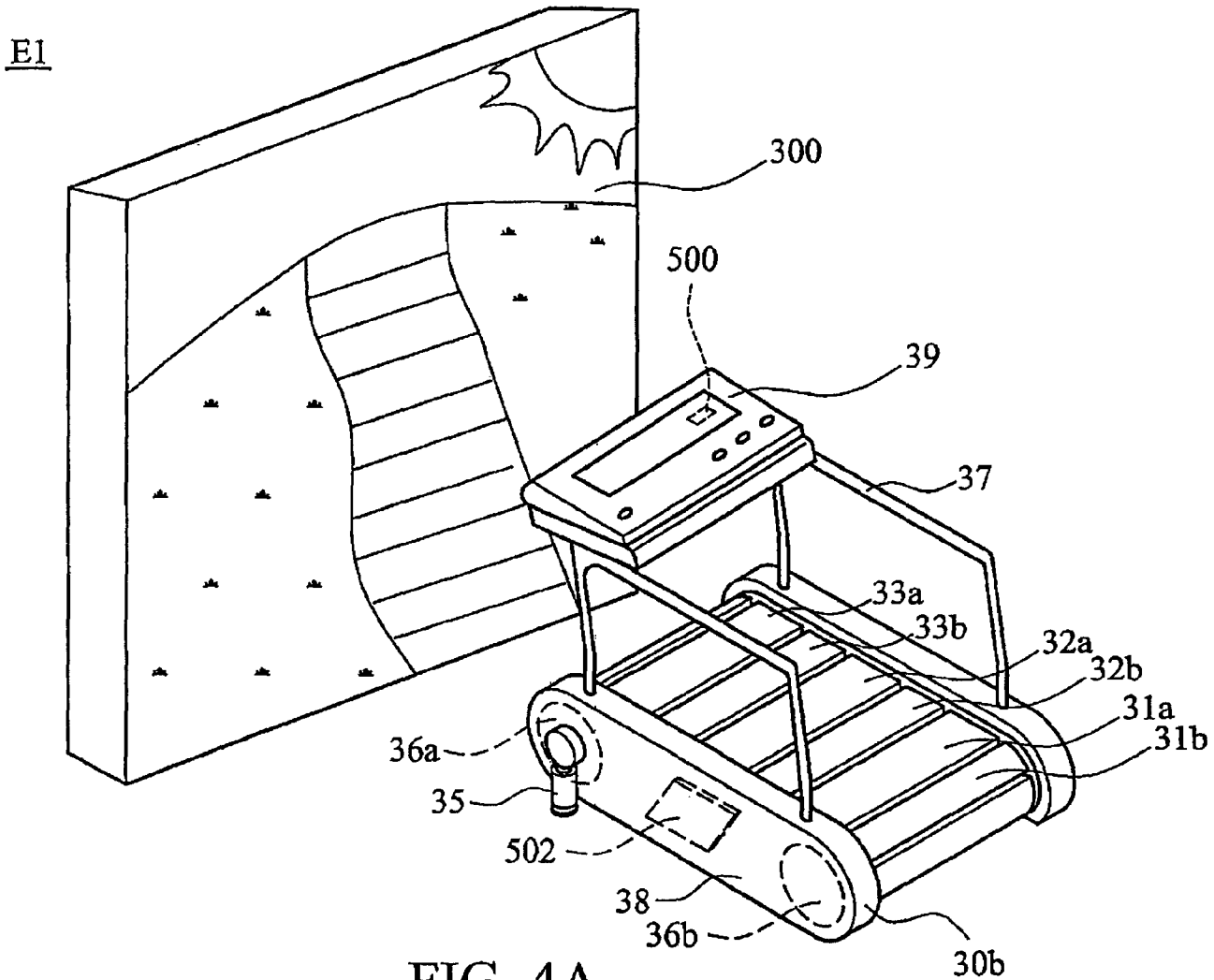
FIG. 4A is a schematic view of the exercise device (E1) deployed in a treadmill configuration.
Figure 4B:
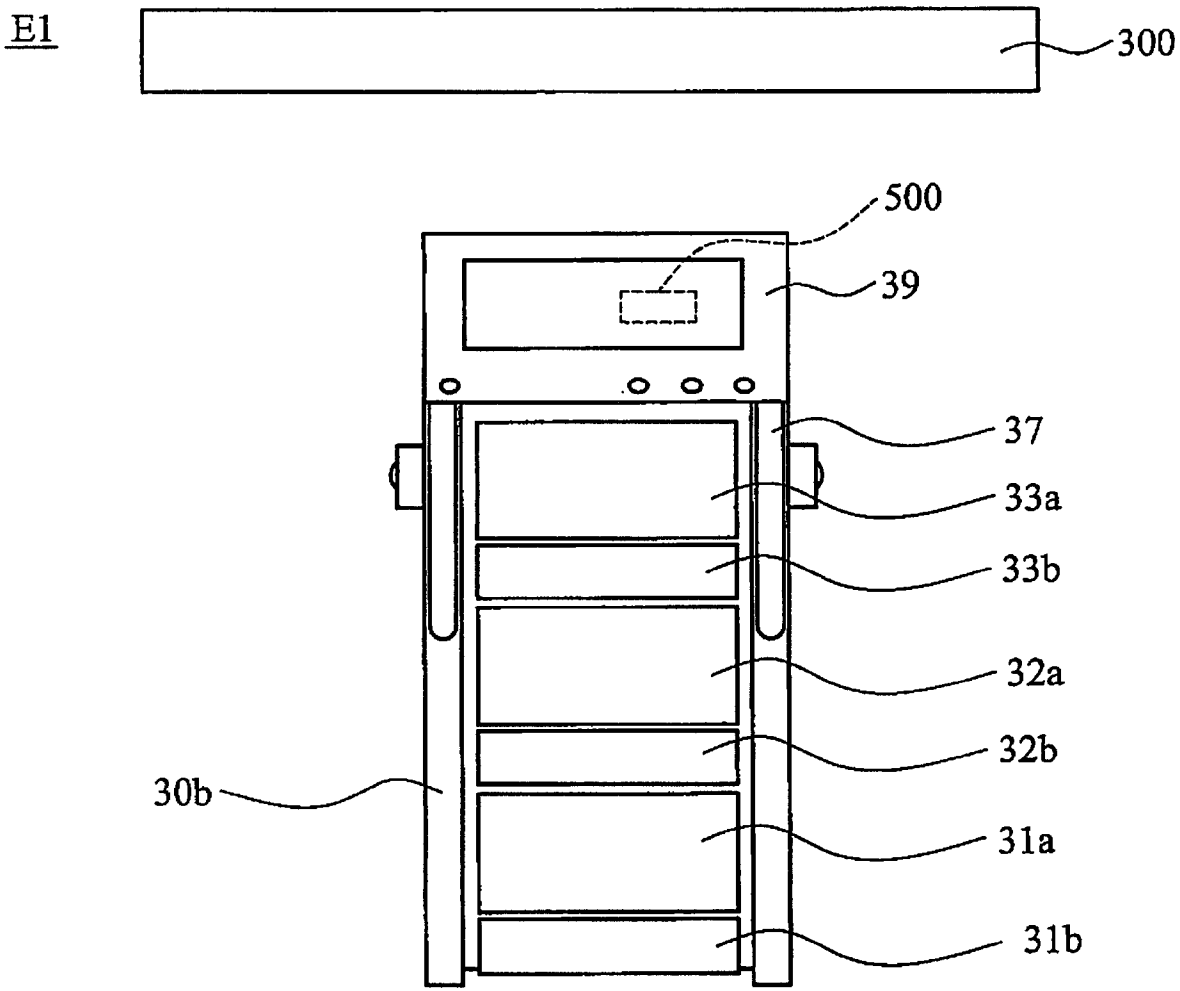
FIG. 4B is a top view of the exercise device (E1) of FIG. 4A.

In FIGS. 4A and 4B, the exercise device E1 of the first embodiment of the invention is deployed in the treadmill configuration.

When the connectors 34 are all removed according to the first deployment shown in FIG. 3D, for example, the treads (31*a*, 32*a*, 33*a* . . . ) and the risers (31*b*, 32*b*, 33*b* . . . ) rotate to lie on the transmission device 30 and form a consecutive surface thereon, and the elevating device 35 is retracted to return the body 30*b* substantially to a horizontal orientation, enabling treadmill function.

Figure 5:
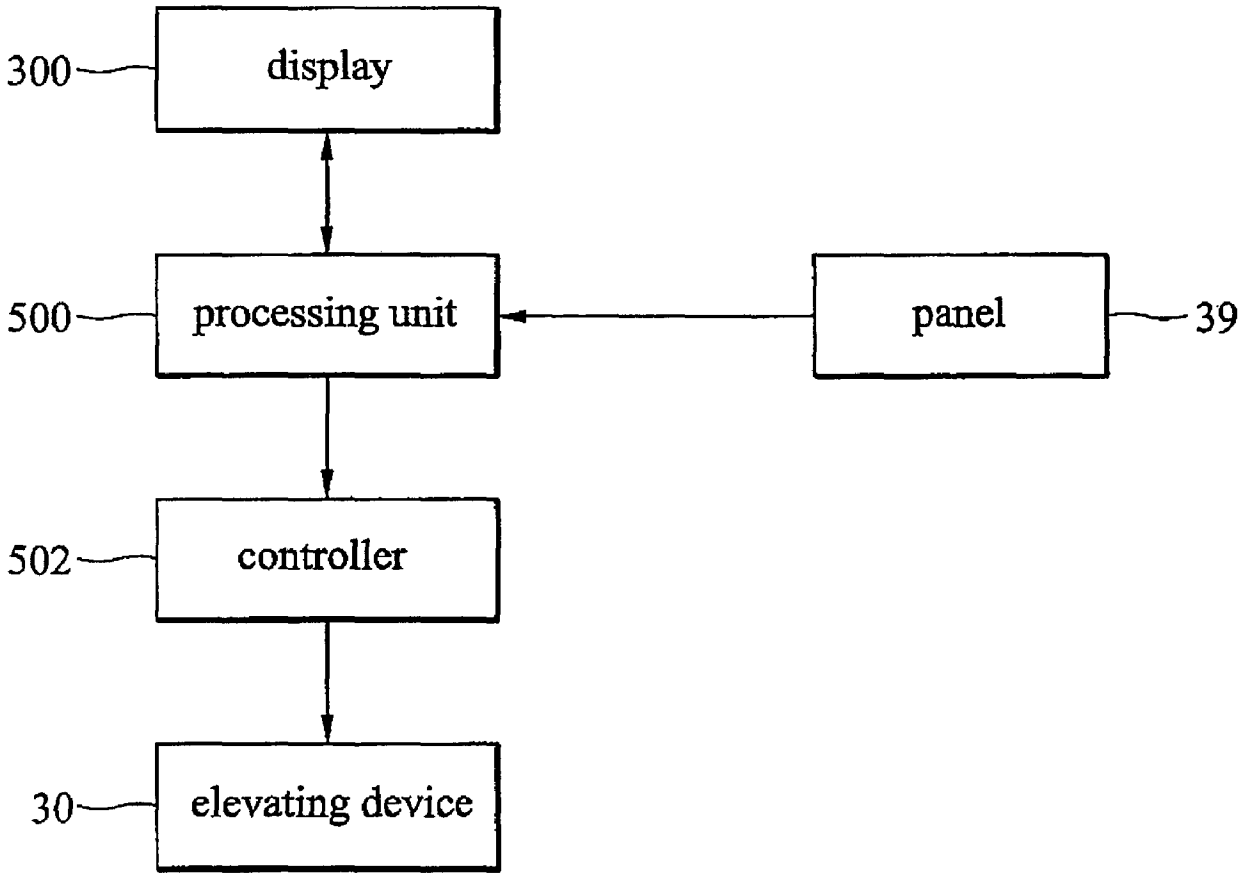
FIG. 5 is a flowchart showing operation of the exercise device (E1) according to the first embodiment of the invention.

FIG. 5 shows the processing unit 500 of the panel 39 coupled to the display 300 and the controller 502 for processing images to appear on the display 300, and controller 502 is coupled to the transmission device 30. Thus, it is easy to switch between stairclimber (FIG. 3A) and treadmill configuration (FIG. 4A) using the panel 39, with speed effectively controlled thereby.

Referring to FIG. 3B, in a second embodiment of the invention, an exercise device E1' is deployed in a stairclimber orientation. Exercise device E1' differs from exercise device E1 in the first embodiment in that a personal display device 700 is provided.

Personal display device 700 allows the display to change with level of activity.

Figure 6A:
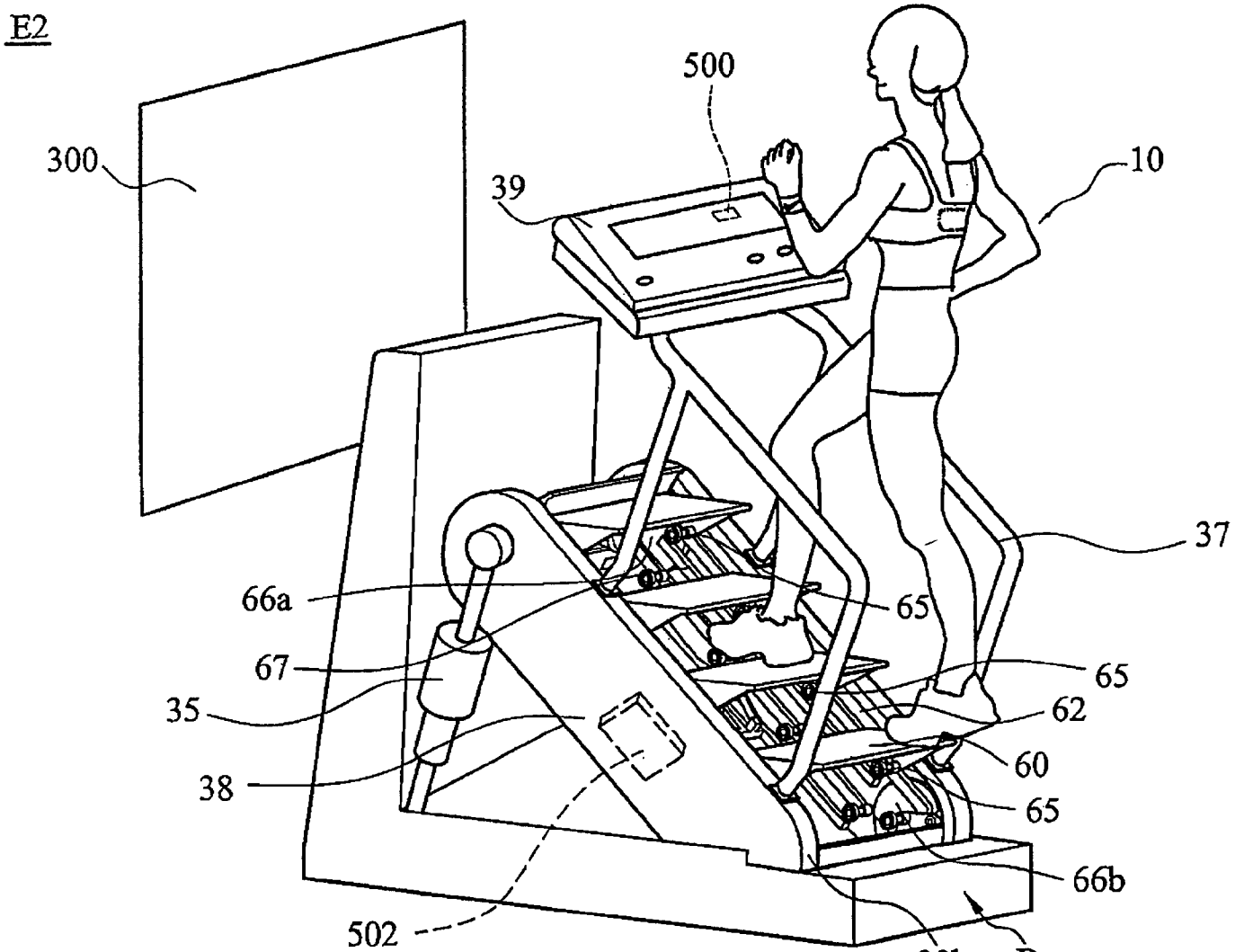
FIG. 6A is a schematic view of an exercise device (E2) of a third embodiment of the invention, with the exercise device (E2) deployed in a stairclimber configuration.

FIG. 6A shows a third embodiment of the invention, in which an exercise device E2 is deployed in a stairclimber orientation.

In the body 30*b* of the exercise device E2, a plurality of treads 60, a belt 62, a plurality of adjusting mechanism 65, two wheels 66*a*, 66*b* and a rail 67 are provided.

The wheels 66*a*, 66*b* are respectively disposed on different sides of the body 30*b* and the belt 62 disposed on the wheels 66*a* and 66*b* moved by the wheels 66*a*, 66*b*. The rail 67 is disposed on the inner wall of the body 30*b*. The treads 60 are movably disposed on the belt 62, each coupled to the belt 62 by the adjusting mechanism 65 guided by the rail 67. The adjusting mechanism 65 supports and adjusts objects to a predetermined angle or position by rotation. Thus, the treads 60 are moved with the belt 62 as the wheels 66*a*, 66*b* rotate.

When the elevating device 35 extends the body 30*b* to a predetermined position or is angled with respect to the horizontal surface, as shown in FIG. 6A, each tread 60 is kept in a horizontal orientation by the corresponding adjusting mechanism 65. The display 300 provides simulated environment.

Figure 6B:
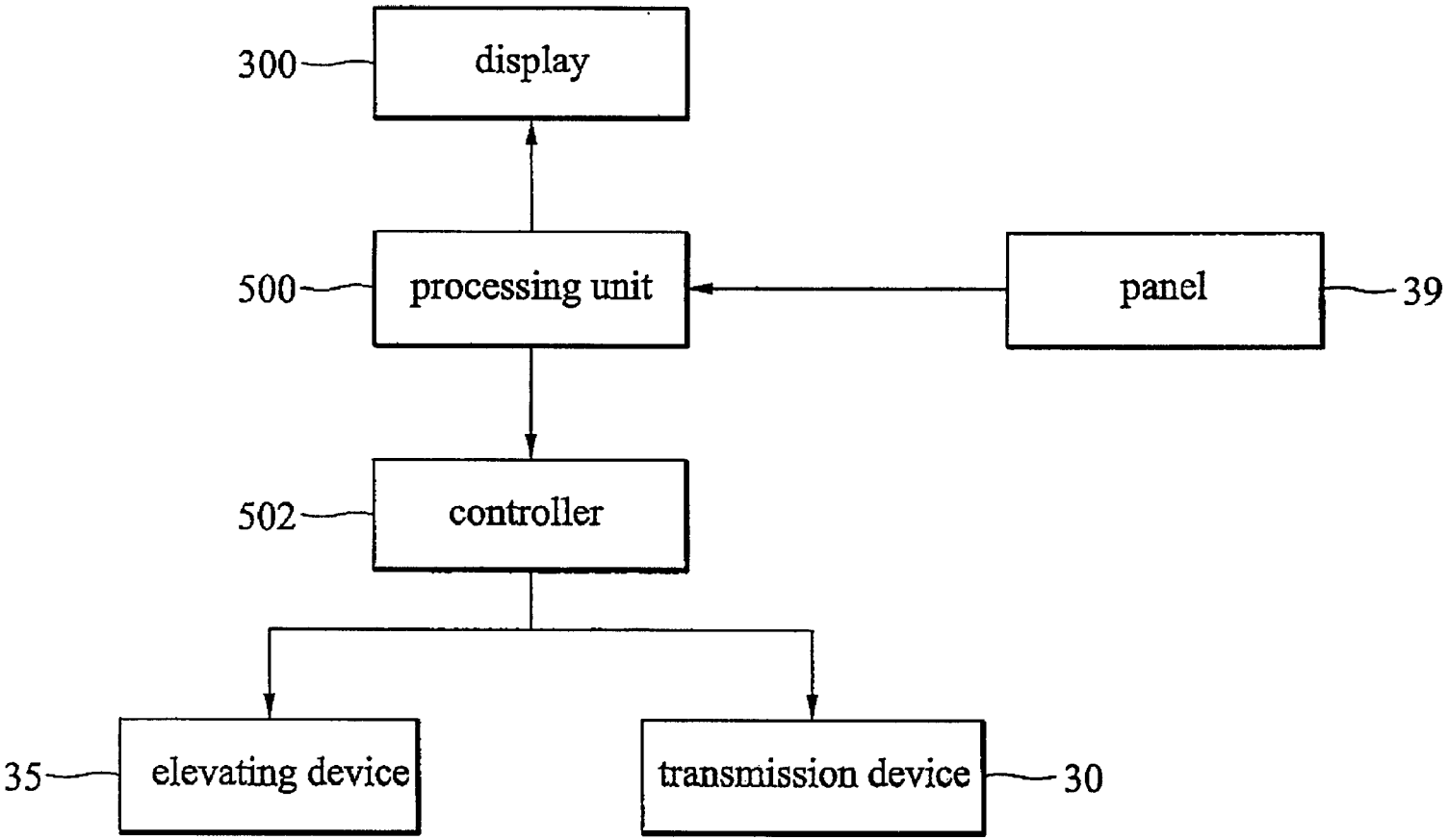
FIG. 6B is a flowchart showing operation of the exercise device (E2) according to the third embodiment of the invention.

In FIG. 6B, operation of the exercise device E2 differs from that of the exercise device E1 in that the controller 502 in FIG. 6B is further coupled to the elevating device 35. Thus, it is easy to control the transmission device 30 and the elevating device 35 of the exercise device E2 through the panel 39, and the speed and deployment of the exercise device E2 are effectively controlled.

Figure 7A:
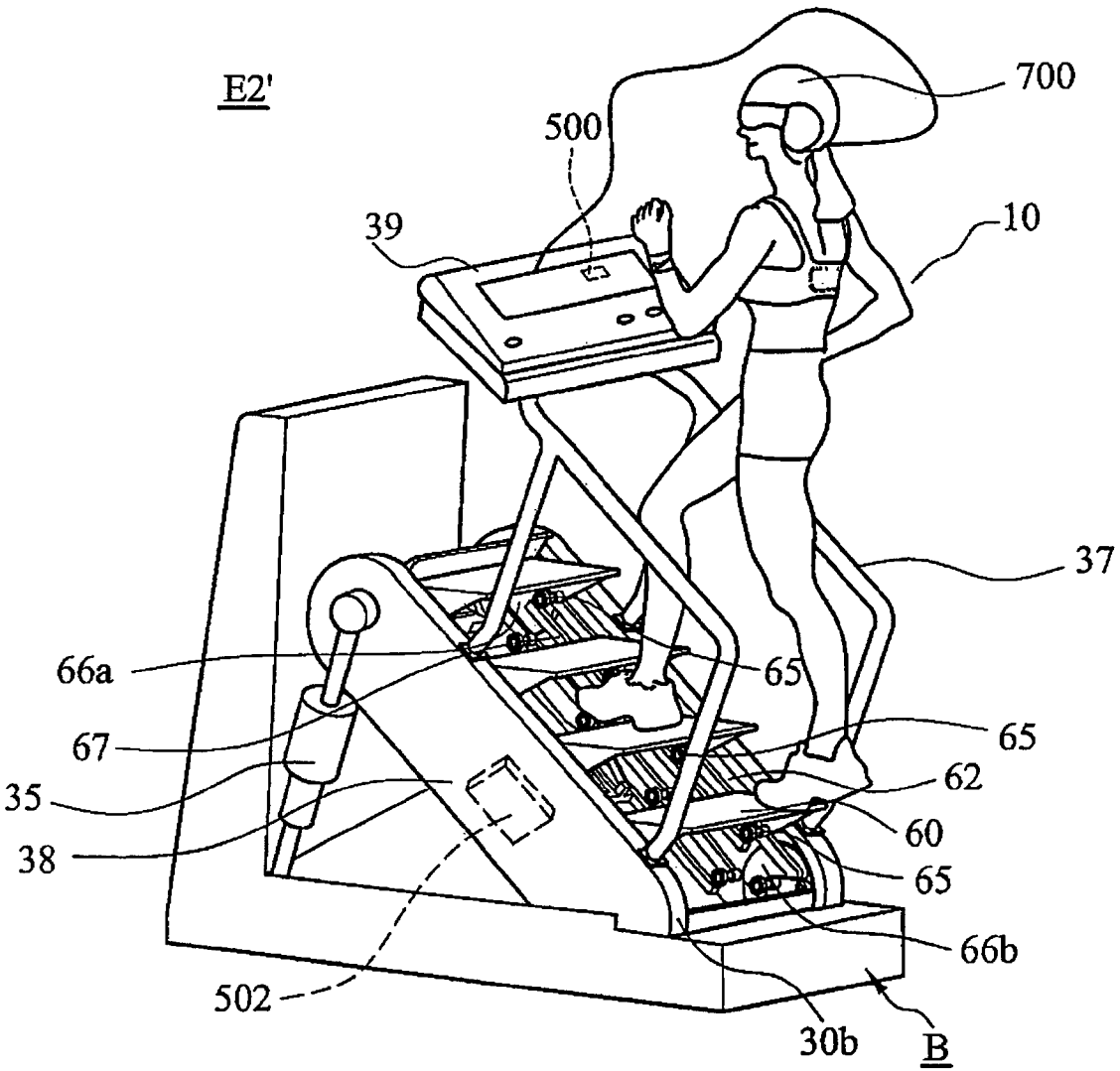
FIG. 7A is a schematic view of an exercise device (E2') of a fourth embodiment of the invention, with the exercise device (E2') deployed in a stairclimber configuration.

Referring to FIG. 7A, in a fourth embodiment of the invention, an exercise device E2' with treadmill and stairclimber functions is deployed in a stairclimber orientation.

The exercise device E2' differs from the exercise device E2 in 6A in that a personal display device 700, coupled to the processing unit 500 of the panel 39 and equipped with audio and video devices, is further provided.

Figure 7B:
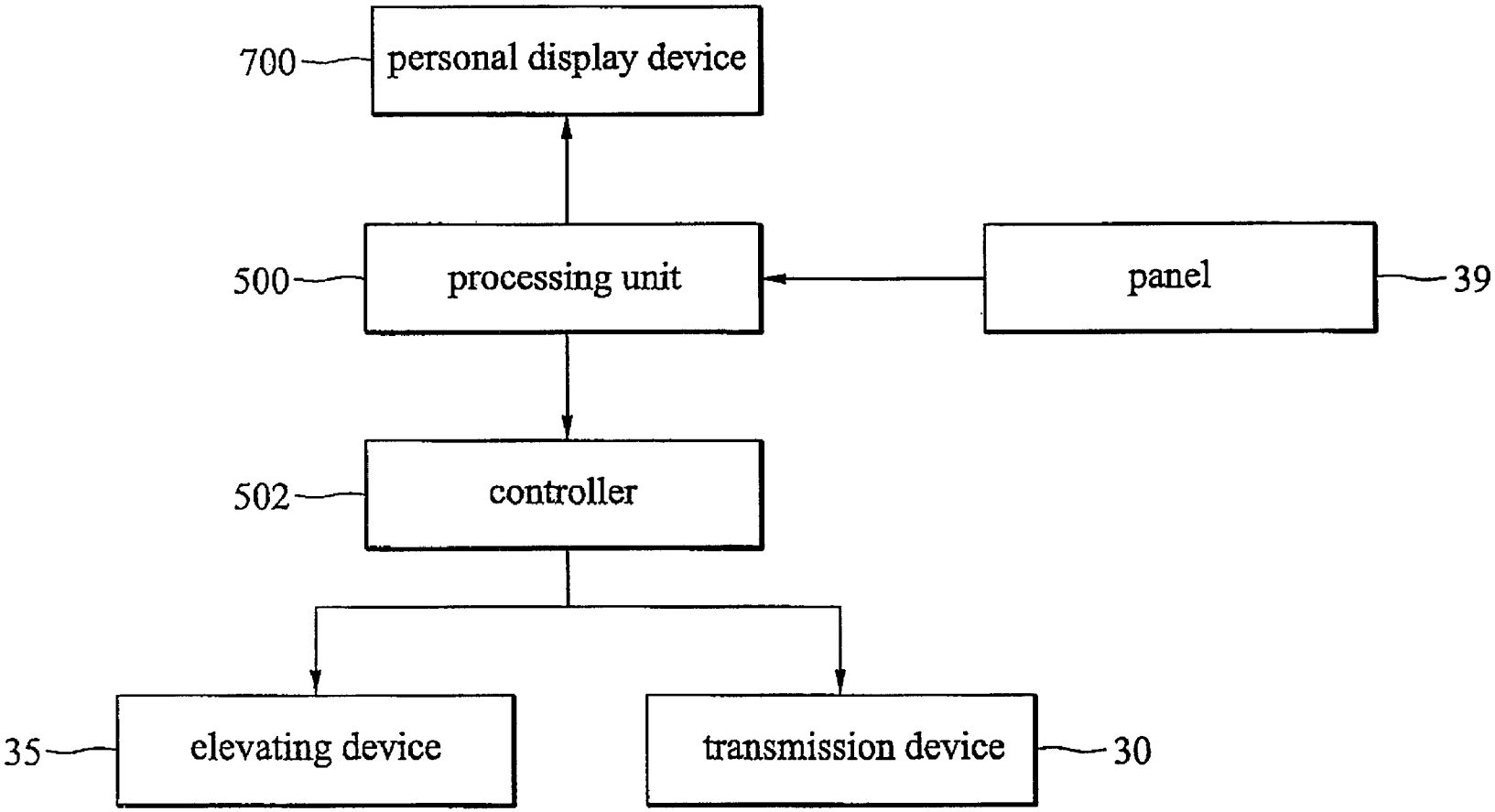
FIG. 7B is a flowchart showing operation of the exercise device (E2') according to the fourth embodiment of the invention.

In FIG. 7B, the operation of the exercise device E2' differs from that of the exercise device E2 in that the personal display device 700 is coupled to the processing unit 500 of the panel 39. Input is thus directly transmitted to the processing unit 500 from the personal display device 700, or through the panel 39.

While the invention has been described in connection with what is presently considered to be the most practical and preferred embodiment, it is to be understood that the invention is not limited to the disclosed embodiments, but, on the contrary, is intended to accommodate various modifications and equivalent arrangements included within the spirit and scope of the appended claims.

What is claimed is:

1. An exercise device providing stairclimber and treadmill configurations, comprising:

a body;

a plurality of treads;

a plurality of risers, each of which is detachably connected to at least one of the treads;

a transmission device disposed in the body and connected to the treads and the risers for moving the treads and the risers, wherein the treads and the risers adjacent thereto are selectively deployed in the stairclimber configuration and in the treadmill configuration, and wherein the treads are substantially coplanar to the risers when deployed in the treadmill configuration; and a plurality of connectors, each of which is detachably disposed between at least one tread and at least one riser, to hold the at least one tread and the at least one riser in a step configuration when deployed in the stairclimber configuration;

wherein the treads are rendered coplanar with the risers by removing the connectors and deploying the treads in the treadmill configuration.

2. The exercise device as claimed in claim 1, further comprising of a plurality of transmission shafts coupled to the transmission device.

3. The exercise device as claimed in claim 1, further comprising of a controller, coupled to the elevating device and the transmission device, controlling the elevating device and the transmission device.

4. The exercise device as claimed in claim 1, wherein the treads are rendered coplanar with the risers by rotating about the connectors and deploying in the treadmill configuration.

5. The exercise device as claimed in claim 1, further comprising an elevating device coupled to the body, to move the body between the stairclimber configuration and the treadmill configuration.

6. The exercise device as claimed in claim 1, further comprising a panel disposed at the front of the exercise device, enabling input of operational settings.

7. The exercise device as claimed in claim 1, further comprising a display unit coupled to the panel, providing an environmental simulation.

8. The exercise device as claimed in claim 7, further comprises a processing unit, disposed on the panel, processing images to appear on the display unit.

9. The exercise device as claimed in claim 7, the display unit could be a display or a personal display device or both of them.

10. The exercise device as claimed in claim 5, wherein the elevating device is a hydraulic device.

11. An exercise device, comprising:

a body;

a plurality of treads;

a belt on which the treads are movably disposed;

a plurality of adjusting mechanisms disposed between the treads and the belt, bracketing the treads and keeping the corresponding treads in a horizontal orientation; and a plurality of connectors, each of which is detachably disposed between at least one tread and at least one riser, to hold the at least one tread and the at least one riser in a step configuration when deployed in a stairclimber configuration;

wherein the treads are rendered coplanar with the risers by removing the connectors and deploying the treads in a treadmill configuration.

12. The exercise device as claimed in claim 11, further comprising of a plurality of wheel, coupled to the belt, moving the treads.

13. The exercise device as claimed in claim 11, further comprising of a controller coupled to the elevating device, controlling the elevating device and the adjusting mechanism.

14. The exercise device as claimed in claim 11, further comprising a display unit coupled to the panel, providing an environmental simulation.

15. The exercise device as claimed in claim 14, further comprises a processing unit, disposed on the panel, processing images to appear on the display unit.

16. The exercise device as claimed in claim 14, the display unit could be a display or a personal display device or both of them.

17. An exercise device providing stairclimber and treadmill configurations, comprising:

a body;

a plurality of treads;

a plurality of risers, each of which is detachably connected to at least one of the treads; and a transmission device disposed in the body and connected to the treads and the risers for moving the treads and the risers, wherein the treads and the risers adjacent thereto are selectively deployed in the stairclimber configuration and in the treadmill configuration, and wherein the treads are substantially coplanar to the risers when deployed in the treadmill configuration, and wherein the stairclimber configuration and the treadmill configuration do not exist simultaneously.

18. The exercise device as claimed in claim 17, wherein the treads are rendered coplanar with the risers by removing connectors and deploying the treads in the treadmill configuration.

19. The exercise device as claimed in claim 17, further comprising an elevating device coupled to the body, to move the body between the stairclimber configuration and the treadmill configuration.

20. The exercise device as claimed in claim 17, further comprising a panel disposed at the front of the exercise device, enabling input of operational settings.

21. The exercise device as claimed in claim 11, further comprising an elevating device coupled to the body, to move the body between the stairclimber configuration and the treadmill configuration.

22. The exercise device as claimed in claim 11, further comprising a panel disposed at the front of the exercise device, enabling input of operational settings.

23. The exercise device as claimed in claim 21, wherein the elevating device is a hydraulic device.

* * * * *